US007153218B1

(12) United States Patent
Elkin

(10) Patent No.: US 7,153,218 B1
(45) Date of Patent: Dec. 26, 2006

(54) GOLF ACCESSORY APPARATUS

(76) Inventor: Robert S. Elkin, 3720 W. Carol Ann Way, Phoenix, AZ (US) 85053

( * ) Notice: Subject to any disclaimer, the term of this patent is extended or adjusted under 35 U.S.C. 154(b) by 0 days.

(21) Appl. No.: 11/022,026

(22) Filed: Dec. 24, 2004

(51) Int. Cl.
*A63B 55/00* (2006.01)

(52) U.S. Cl. ..... 473/282

(58) Field of Classification Search ..... 473/282; 43/21.2; 211/70.2, 70.8; D21/796; D6/552; 248/156, 511, 530, 688, 520, 176.1, 125.7, 248/125.9

See application file for complete search history.

(56) References Cited

U.S. PATENT DOCUMENTS

| | | | | | |
|---|---|---|---|---|---|
| 1,652,594 | A | * | 12/1927 | Walker | 473/308 |
| 5,149,087 | A | | 9/1992 | Thompson, Jr. | |
| D360,248 | S | | 7/1995 | Wright | |
| D360,451 | S | * | 7/1995 | Levocz et al. | D21/796 |
| 5,503,394 | A | | 4/1996 | Mauck et al. | |
| 5,588,448 | A | * | 12/1996 | Photakis | 131/259 |
| 5,597,363 | A | | 1/1997 | Leote | |
| 5,749,386 | A | * | 5/1998 | Samuel, Jr. | 135/16 |
| 5,813,414 | A | | 9/1998 | Zutler et al. | |
| 5,820,479 | A | | 10/1998 | Cline et al. | |
| 5,873,471 | A | | 2/1999 | Ruggeri | |
| 5,884,881 | A | * | 3/1999 | Band et al. | 248/166 |
| D411,034 | S | | 6/1999 | Evans | |
| 6,260,717 | B1 | | 7/2001 | Keller, Jr. | |
| 6,346,051 | B1 | | 2/2002 | Otsubo | |
| 6,447,407 | B1 | * | 9/2002 | Caldwell | 473/408 |
| 2003/0207721 | A1 | | 11/2003 | Hall et al. | |
| 2004/0198527 | A1 | * | 10/2004 | Hsieh | 473/282 |

* cited by examiner

*Primary Examiner*—Stephen Blau
(74) *Attorney, Agent, or Firm*—Parsons & Goltry; Robert A. Parsons; Michael W. Goltry

(57) ABSTRACT

A golf accessory apparatus includes an elongated trough coupled to an elongated rod. The elongated trough is configured to receive a golf club so that its handle end is held off the ground when a first end of the elongated rod is coupled to the ground. The elongated trough can be pivotally coupled to the elongated rod and it can frictionally engage the golf club. The elongate trough has one or both of its ends shaped so that it can be easily inserted into a golf bag.

18 Claims, 2 Drawing Sheets

12b
12
15
28
19
18d
18
20
24
20b
12a
18a
26
10
18b
18c
23
20c
22
24a
24
20b
20a
27
10
12b
18
19
18a
23
18c
18b
22
22a
12

GOLF ACCESSORY APPARATUS

BACKGROUND OF THE INVENTION

1. Field of the Invention

The present invention relates generally to golf, and, more particularly, to a golf accessory apparatus that operates as a golf tool and a support structure for supporting golf clubs.

2. Related Art and Prior Art Statement

Golf is a tremendously popular sport that can be played by people of all ages. In this sport, a typical golfer carries more than one golf club to the position of a golf ball and then makes a decision as to which club will be used for the next shot. For example, it is common for a golfer to pull a chipping wedge and a putter from his or her golf bag and carry both clubs to and around the green while completing a hole. One problem with this is that the green or fairway can be damp. Thus, the golf club not in use, and particularly the handle portion, can become wet from the moisture associated with the green or fairway if it is laid on the ground.

Another activity which is commonly performed in golf involves repairing specific locations upon a golf course during play. These locations can include ball marks which sometimes are formed upon the surface of a green from the impact of the golf ball or they can include divots formed from swinging the golf club and striking the ground. It is common courtesy for the golfer to repair the damaged locations. For example, ball marks on the green can be repaired by pulling up the ball mark or depression with a repair tool commonly carried in the golfer's pocket.

However, the conventional tools available for performing this operation require the user to bend over or kneel down and repair the damage. This is again an uncomfortable operation for some golfers, particularly the elderly or the physically challenged. Because it is physically difficult for some golfers to perform these operations, they will sometimes leave the green damaged without repair.

BRIEF SUMMARY OF THE INVENTION

The present invention provides a golf accessory apparatus which includes an elongated trough coupled to an elongated rod. The elongated trough can be used to hold a portion of a golf club above the ground while golfing. This can be done by inserting a ground penetrating end of the rod into the ground so that its handle end and the elongated trough are held above the ground. The head of the golf club can be positioned on the ground and its shaft can be leaned against the elongated trough. Accordingly, the golf accessory apparatus provides a convenient location to position the golf club when the golf club is out of the bag.

In one aspect of the present invention, the elongated trough is formed so that the golf accessory apparatus can be easily inserted into a golf bag. One reason it can be easily inserted is because the elongated trough and rod are coupled together with a rivet or another fastener so that the elongated trough can pivotally rotate. In this way, the elongated trough can be aligned with the elongated rod so that they can both slide into the golf bag without catching on any golf clubs already inserted into the golf bag or the golf bag itself.

Another reason it can be easily inserted is because the ends of the elongated trough are shaped so that they do not catch on the golf clubs or the golf bag. In one embodiment, the ends are tapered so that they form a point. These ends can also have beveled edges. The tapered ends and beveled edges make it easier for the golf accessory apparatus to be inserted into the golf bag because they are shaped to slide past any structure that may otherwise catch onto the golf accessory apparatus as it slides in when the elongated trough is aligned with the elongated rod.

In another aspect of the present invention, an inner surface of the elongated trough can be shaped to receive the golf club. In one embodiment, the shape of the inner surface can be chosen so that the golf club leans freely on the elongated trough. In these embodiments, the elongated trough can have various cross-sectional shapes, such as semicircular, square, or U-shaped. In other embodiments, however, the elongated trough can be shaped so that the golf club clips into it. For example, the elongated trough can be tapered along its longitudinal axis to closely match the tapering of the golf club shaft. In either of these embodiments, the handle end of the golf club is held above the ground by the elongated trough so that it does not get wet or dirty when not in use.

In one aspect of the present invention, the ground penetrating end of the elongated rod is configured to be inserted into the ground so that a portion of it stands above the ground. A ground penetrating structure can be coupled to the ground penetrating end of the elongated shaft. The ground penetrating structure can be welded thereto or it can be held in place with fasteners. In this way, the elongated trough can support the golf club in an upright position or in a position so that its handle is above the ground. In some embodiments, the ground penetrating end is shaped so that it can be used to fix divots usually encountered on the golf course.

In another aspect of the present invention, a sleeve can be positioned around the elongated rod so that it covers the welding joint or the fasteners holding the elongated rod and ground penetrating structure together. In this way, the sleeve protects the welding joint or the fasteners from moisture and/or dirt. The sleeve can be elastic so that it tightly fits the shape of the elongated rod and makes it more difficult for moisture and/or dirt to get underneath it.

These and other features, aspects, and advantages of the present invention will become better understood with reference to the following drawings, description, and claims.

BRIEF DESCRIPTION OF THE DRAWINGS

Referring to the drawings.

DETAILED DESCRIPTION OF THE INVENTION

Figures 1, 2, 3:
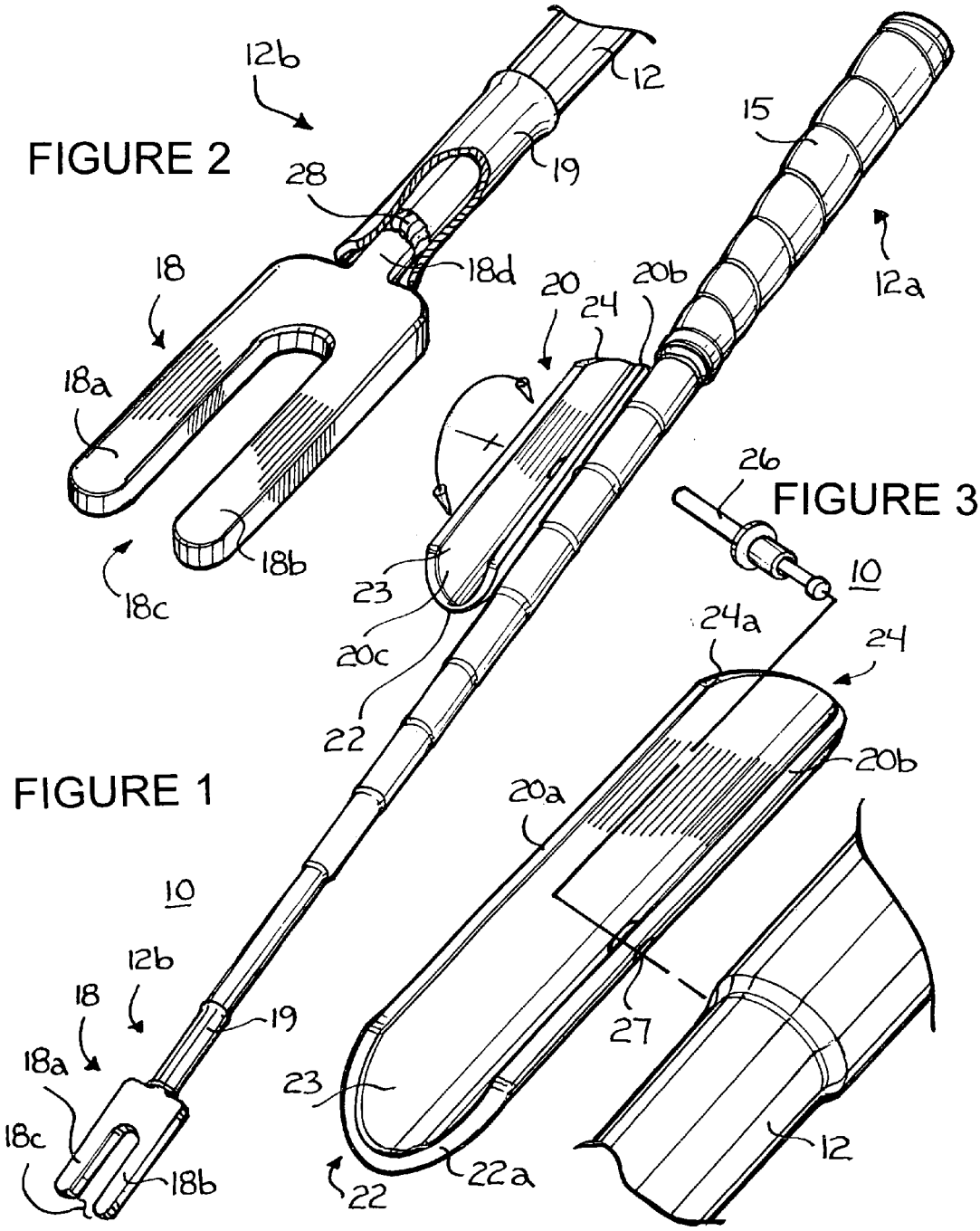
FIG. 1 is a simplified perspective view of a golf accessory apparatus in accordance with the present invention.
FIG. 2 is a more detailed perspective view of the ground penetrating end of the golf accessory apparatus of FIG. 1.
FIG. 3 is a more detailed exploded perspective view of a golf club holder of the golf accessory apparatus of FIG. 1.

Turning now to the drawings, in which like reference characters indicate corresponding elements throughout the several views, attention is first directed to FIG. 1 in which there is seen a simplified block diagram of a golf accessory apparatus 10 in accordance with the present invention. Apparatus 10 can be used to hold a golf club and it can be used to repair divots or other damage often encountered on a golf course. Apparatus 10 can hold the golf club or repair damage without requiring the golfer to kneel down or bend over, which can be difficult for some golfers. Apparatus 10 can hold the golf club so that its handle does not get wet or dirty, which can cause gripping problems when trying to hit a golf ball. Apparatus 10 can also be easily slid into a golf bag without catching on golf clubs already inserted into the golf bag or the golf bag itself.

In one embodiment, golf accessory apparatus 10 includes an elongated trough 20 coupled to an elongated rod 12. Elongated rod 12 is shaped like a golf club shaft and has a handle end 12*a* and a ground penetrating end 12*b*, although rod 12 can be other shapes such as round or square. Elongated rod 12 has a handle end 12*a* and a ground penetrating end 12*b*. A grip 15, which in this example is a golf club grip, is positioned on handle end 12*a* so that a person can easily grasp it.

In this embodiment, ground penetrating end 12*b* is capable of being inserted into the ground so handle end 12*a* and grip 15 are held above the ground. As better seen in FIG. 2, ground penetrating end 12*b* includes a ground penetrating structure 18, which is a bifurcated fork with prongs 18*a* and 18*b* separated by an opening 18*c*. Prongs 18*a* and 18*b* are coupled to an extension 18*d* which extends in an opposed direction to prongs 18*a* and 18*b*.

Structure 18 is coupled to rod 12 by welding extension 18*d* to ground penetrating end 12*b* of rod 12 to form a welding joint 28. However, these elements can be coupled together in other ways, such as with fasteners, screws, or bolts. It should be noted that structure 18 can have other shapes and/or configurations, but is shown as a fork structure here for ease of discussion. For example, extension 18*d* can be coupled to prongs 18*a* and 18*b* so that these prongs are at an angle to elongated rod 12 when extension 18*d* is welded thereto.

Figure 5:
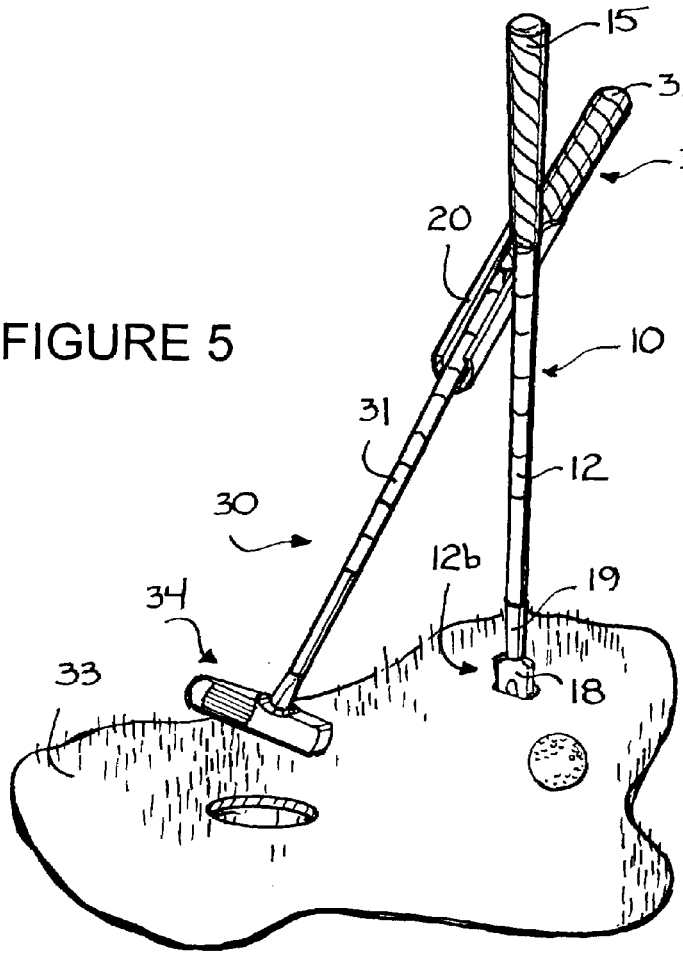
FIG. 5 is a simplified perspective view of the golf accessory apparatus of FIG. 1 with its ground penetrating end inserted into the ground and its golf club holder holding a golf club.

In other embodiments, ground penetrating structure 18 can have a single pointed end or it can be flat or shovel-shaped. In any of these embodiments, however, structure 18 is shaped so that it can be easily inserted into ground 33, as shown in FIG. 5. In this particular example, structure 18 is fork shaped as described above so that it can be more easily used to fix divots and other damage typically found on a golf course.

In accordance with the invention, a sleeve 19 is fitted around ground penetrating end 12*b* to protect the intersection of structure 18 and elongated shaft 12 from moisture and/or dirt. In particular, sleeve 19 is positioned around end 12*b* to protect welding joint 28, as shown in FIG. 2, in which ground penetrating end 12*b* of rod 12 is shown in a partial cutaway view.

Sleeve 19 can include a plastic or rubber material which is elastic and preferably waterproof. In this way, it can be tightly fitted into place to reduce the amount of dirt and/or moisture that gets underneath it. In some embodiments, sleeve 19 can be made to tightly fit over ground penetrating end 12*b* by heat shrinking it. Sleeve 19 can also be included so that it hides welding joint 28 to make apparatus 10 more aesthetically pleasing. Similarly, sleeve 19 can be used to hide and protect the fasteners in the embodiments that include fasteners to hold elongate rod 12 and structure 18 together.

In accordance with the invention, elongated trough 20 is pivotally coupled to elongated rod 12 between handle end 12*a* and ground penetrating end 12*b*, as shown in FIGS. 1 and 5. Elongated trough 20 is coupled to elongated rod 12 so that it is held above the ground when ground penetrating end 12*b* is inserted therein. In this way, elongated trough 20 can receive a golf club 30 (See FIG. 5) so that its handle end 30*a* is held off ground 33. Support structure 20 can be formed of plastic or another material which can support a golf club 30 without damaging it.

Elongated trough 20 is pivotally coupled to rod 12 so that trough 20 can pivotally rotate and be aligned with rod 12. In this way, elongated trough 20 can be aligned parallel with elongated rod 12 so that they can both slide into golf bag 17 without catching on any golf clubs already inserted into the golf bag or the golf bag itself. Elongated trough 20 can also be oriented so that its longitudinal axis is at an angle relative to rod 12 so that it can hold golf club 30.

As best seen in FIG. 3, support structure 20 has a semicircular shape so that it can receive one or more gulf clubs without having them slide sideways off of it. Accordingly, trough 20 includes sidewalls 20*a* and 20*b* coupled together with a support surface 20*c* wherein sidewalls 20*a* and 20*b* and support surface 20*c* are curved. Support surface 20*c* and sidewalls 20*a*, 20*b* define an inner surface 23 shaped to receive golf club 30. These surfaces can be shaped to receive shaft 31 and/or handle 32 of golf club 30.

Figure 4:
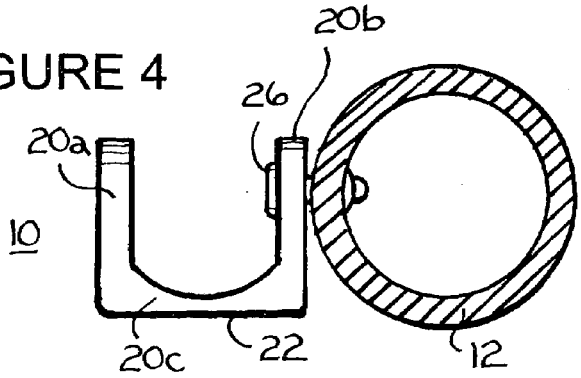
FIG. 4 is a simplified sectional view of the shaft and golf club holder of the golf accessory apparatus of FIG. 1.

In other embodiments, sidewalls 20*a*,20*b* and surface 20*c* can have other shapes. For example, support surface 20*c* can be curved and sidewalls 20*a* and 20*b* can be flat as shown in FIG. 4. In other examples, structure 20 can have other cross-sectional shapes, such as square or U-shaped. In these examples, the cross-sectional shape of structure 20 should be chosen so that it is difficult for the golf club to slide sideways off of it.

Sidewall 20*b* is fastened to elongated rod 12 with a rivet 26 as best seen in FIG. 4, however, sidewall 20*b* can be fastened to rod 12 with another fastening device, such as a pin, screw, or bolt. This allows elongated trough 20 to rotate about an angle θ, as shown in FIGS. 1 and 5. In this way, a head portion 34 of golf club 30 can be positioned on ground 33 and handle end 32 can be held by structure 20. Since structure 20 can pivotally rotate, golf club 30 can be tilted at an angle relative to rod 12, so that club 30 is less likely to fall off of structure 20.

Support structure 20 extends longitudinally so that its opposed ends 22 and 24 extend away from rivet 26. As shown in FIG. 3, end 22 has a width $w_1$ and end 24 has a width $w_2$, where $w_1$ is equal to $w_2$. Widths $w_1$ and $w_2$ can be chosen so that support structure 20 holds one or more golf clubs freely. In other embodiments, however, $w_1$ can be made to be unequal to $w_2$ so that support structure 20 can frictionally hold a single golf club, such as golf club 30. The dimensions of $w_1$ and $w_2$ can be chosen to closely match the tapered dimensions of golf club 30 so that golf club 30 clips into structure 20. This reduces the chances that golf club 30 can inadvertently fall out of structure 20 and land on the ground where it can become wet and/or dirty.

Figure 6:
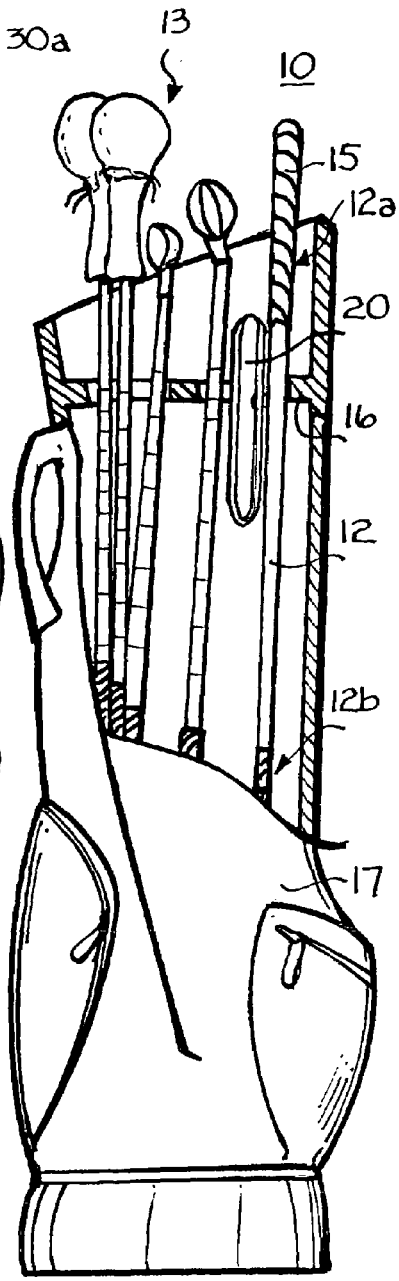
FIG. 6 is a simplified view of the golf accessory apparatus of FIG. 1 inserted into a golf bag.

In accordance with the invention, ends 22 and 24 are shaped so that apparatus can be more easily inserted into a golf bag 17 when structure 20 is aligned with rod 12, as shown in FIG. 6. There may be difficulty in inserting apparatus 10 because it typically includes an organizer 16 positioned in an upper portion of bag 17. Organizer 16 includes openings for receiving golf clubs 13 and golf accessory apparatus 10 and is used to organize the positioning of golf clubs 13 positioned therein.

There are several ways in which ends 22 and 24 can be shaped so that golf accessory apparatus 10 can be more easily inserted into golf bag 17. One way is to taper ends 22 and 24 so that they are pointed. Another way is to bevel edges 22*a* and 24*a*, respectively, of ends 22 and 24. In this way, structure 20 will more easily slide into golf bag 17 when golf accessory apparatus 10 is inserted into it. This will happen because structure 20 is less likely to catch on any golf clubs in bag 17.

Structure 20 is also less likely to catch on any portions of bag 17, such as organizer 16, as it is being inserted. For example, when apparatus 10 is inserted into bag 17, structure 20 can be aligned with rod 12. Accordingly, one of ends 22 and 24 can engage the lip of an opening in organizer 16. However, since ends 22 and 24 are pointed, they will slide into the corresponding opening of organizer 16 without catching on it. Hence, elongated trough 20 has both of its ends shaped so that they function as a guide when apparatus 10 is inserted into golf bag 17.

It should be noted that both ends 22 and 24 are tapered in this embodiment for illustrative purposes. However, in other embodiments, only one of ends 22 or 24 can be tapered. In these embodiments, structure 20 should be rotated so that the tapered end is pointed towards the end of rod 12 that is being inserted into bag 17 first. In this way, the tapered end will slide past any golf clubs or portions of golf bag 17 that structure 20 may come into contact with. For example, in FIG. 6, ground penetrating end 12*b* is inserted first into golf bag 17 so the tapered end of structure 20 should be rotated so that it points towards end 12*b*. If handle end 12*b* is inserted into bag 17 first, then the tapered end of structure 20 should be pointed towards end 12*b*.

The present invention is described above with reference to preferred embodiments. However, those skilled in the art will recognize that changes and modifications may be made in the described embodiments without departing from the nature and scope of the present invention. Various further changes and modifications will readily occur to those skilled in the art. To the extent that such modifications and variations do not depart from the spirit of the invention, they are intended to be included within the scope thereof.

The invention claimed is:

1. A golf accessory apparatus comprising:

an elongated rod having a handle end and a ground penetrating end, the ground penetrating end being capable of being inserted into the ground so the handle end is held above the ground; and an elongated trough pivotally coupled to and in juxtaposion with the elongated rod intermediate a handle end and a ground penetrating end, the elongated trough including a first sidewall extending between a first end and a second end, the first sidewall rotatably coupled to the elongated rod intermediate the first end and the second end, the elongated trough rotatable between an aligned position wherein a longitudinal axis of the elongated trough is parallel to the elongated rod and a deployed position wherein the longitudinal axis of the elongated trough is angled relative the elongated rod, the elongated trough being shaped so that the elongated rod and trough can be easily inserted into a golf bag when the elongated trough is aligned with the elongated rod wherein the elongated trough further includes a second sidewall coupled to the first sidewall by a support surface, the support surface and first and second sidewalls being shaped to receive at least one golf club shaft.

2. The apparatus of claim 1 wherein the elongated trough is shaped along its longitudinal axis so that it can frictionally receive the at least one golf club shaft.

3. The apparatus of claim 1 wherein the elongated trough has at least a portion of its edge shaped so that it can be easily inserted into a golf bag when the longitudinal axis of the elongated trough is aligned with the elongated rod.

4. The apparatus of claim 1 wherein at least one end of the elongated trough is shaped so that it can be easily inserted into a golf bag when the longitudinal axis of the elongated trough is aligned with the elongated rod.

5. The apparatus of claim 1 wherein the first sidewall of the elongated trough is coupled to the elongated rod with a fastener which allows the elongated trough to rotate.

6. The apparatus of claim 1 wherein the elongated rod is shaped like a golf club shaft.

7. A golf accessory apparatus comprising:

an elongated rod having a handle end and a ground penetrating end, the ground penetrating end being capable of being inserted into the ground so the handle end is held above the ground; and a longitudinally extending concave support structure with a first sidewall pivotally coupled to the elongated rod the concave support structure further includes a second sidewall coupled to the first sidewall by a support surface, the support structure being configured to receive a golf club;

wherein at least one end of the support structure is tapered to a point so that it can be easily inserted into a golf bag when the longitudinal axis of the support structure is aligned with the elongated rod.

8. The apparatus of claim 7 wherein an inner surface of the support structure is shaped to frictionally engage the golf club.

9. The apparatus of claim 7 wherein the at least one end of the support structure has an edge with a beveled shape.

10. The apparatus of claim 7 further including a fork coupled to the ground penetrating end of the elongated rod.

11. The apparatus of claim 10 further including a sleeve which fits over the intersection of the fork and elongated rod.

12. A golf accessory apparatus comprising:

a golf club shaft;

a hand grip positioned on one end of the golf club shaft;

a ground penetrating structure coupled to an opposing end of the golf club shaft, the ground penetrating structure being capable of being inserted into the ground to hold the hand grip above the ground; and a longitudinally extending concave support structure with a first side pivotally coupled to the golf club shaft the concave support structure further includes a second side coupled to the first side by a support surface, the support structure being configured to support a handle end of a golf club;

wherein at least one end of the longitudinally extending concave support structure is pointed so that it can be easily inserted into a golf bag when the longitudinal axis of the support structure is aligned with the golf club shaft.

13. The apparatus of claim 12 wherein the support structure has a semicircular, square, or U-shaped cross section.

14. The apparatus of claim 12 wherein an inner surface of the support structure is shaped to frictionally receive the handle end of the golf club.

15. The apparatus of claim 12 wherein the support structure has an edge with a beveled shape so that it can be easily inserted into a golf bag when the longitudinal axis of the support structure is aligned with the golf club shaft.

16. The apparatus of claim 12 wherein the support structure has a tapered shape so that it can be easily inserted into a golf bag when the longitudinal axis of the support structure is aligned with the golf club shaft.

17. The apparatus of claim 12 wherein the ground penetrating structure is shaped to fix divots or other damage typically found on a golf course.

18. The apparatus of claim 12 wherein the support structure is tapered along its longitudinal axis so that it can frictionally receive the handle end of the golf club.

* * * * *